US007011609B1

(12) United States Patent
Kuo

(10) Patent No.: US 7,011,609 B1
(45) Date of Patent: Mar. 14, 2006

(54) COUNTERWEIGHT EXERCISE MACHINE

(76) Inventor: Hai Pin Kuo, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/051,914

(22) Filed: Feb. 7, 2005

(51) Int. Cl.
*A63B 21/062* (2006.01)

(52) U.S. Cl. ..... 482/94; 482/99

(58) Field of Classification Search ..... 482/92–94, 482/98–103
See application file for complete search history.

(56) References Cited

U.S. PATENT DOCUMENTS

| | | | | |
|---|---|---|---|---|
| 4,349,192 | A | 9/1982 | Lambert et al. | 482/101 |
| 4,538,805 | A | 9/1985 | Parviainen | 482/98 |
| 4,627,615 | A | 12/1986 | Nurkowski | 482/98 |
| 4,834,365 | A | 5/1989 | Jones | 482/100 |
| 4,971,305 | A | 11/1990 | Rennex | 482/93 |
| 5,556,362 | A | 9/1996 | Whipps | 482/98 |
| 5,776,040 | A | 7/1998 | Webb et al. | 482/98 |
| 5,935,048 | A | 8/1999 | Krull | 482/98 |
| 6,387,018 | B1 | 5/2002 | Krull | 482/98 |
| 6,387,019 | B1 | 5/2002 | Krull | 482/98 |
| 6,436,013 | B1 | 8/2002 | Krull | 482/94 |
| 6,551,223 | B1 | 4/2003 | Cheng | 482/99 |
| 6,666,800 | B1 * | 12/2003 | Krull | 482/94 |
| 6,719,672 | B1 * | 4/2004 | Ellis et al. | 482/99 |
| 2003/0060344 | A1 | 3/2003 | Varner | 482/98 |
| 2003/0092542 | A1 * | 5/2003 | Bartholomew et al. | 482/99 |
| 2005/0176559 | A1 * | 8/2005 | Carter | 482/94 |

* cited by examiner

*Primary Examiner*—Jerome W. Donnelly
*Assistant Examiner*—Victor K. Hwang

(57) ABSTRACT

A counterweight exercise machine has a frame. The frame comprises two main guide rods; two sub-guide rods; a passive rod parallel to the two main guide rods; at least one main weight; a selector; a base having a lower substrate and an upper substrate; and two sleeves connected to the lower substrate and the upper substrate; at least one pin capable of passing through the round holes of the front sheet and the rear sheet and the passive rod; and at least one sub-weight. By above mentioned components, the selector serves to lock a predetermined number of main weights and the pin inserts into the sub-weight so as to increase the total weight. A force applied unit serves to drive the passive rod to drive the main weight and the sub-weight to operate along the main guide rods and sub-guide rods to achieve the object of training the muscle.

3 Claims, 7 Drawing Sheets

COUNTERWEIGHT EXERCISE MACHINE

FIELD OF THE INVENTION

The present invention relates to exercise machines, and in particular to a counterweight exercise machine which has main weights and sub-weights. The sub-weights are fixed by at least one pin so as to be operated on two sets of guide rods with the main weights. Different weights can be assembled to have a desire weight for training the muscles of the users according to the physical condition and the willingness of the user.

BACKGROUND OF THE INVENTION

The current counterweight exercise machine has a frame for supporting a plurality of weights. The user assembles a predetermined number of weights for training the hands or legs of the user in vertical direction. Users can train his (or her muscle) by applying a force to balance the weight of the weights. In some improve designs, some sub-weights are used with the main weights to cause that the user can assemble some weights to have a desire weight. However the sub-weights are directly added to the main weights, it is inconvenient as the user detaches the sub-weights from the main weights.

SUMMARY OF THE INVENTION

Accordingly, the primary object of the present invention is to provide a counterweight exercise machine which have main weights and sub-weights. The sub-weights are fixed by at least one pin so as to be operated on two sets of guide rods with the main weights.

A counterweight exercise machine has a frame. The frame comprises two main guide rods; two sub-guide rods; a passive rod parallel to the two main guide rods; at least one main weight; a selector; base having a lower substrate and an upper substrate; and two sleeves connected to the lower substrate and the upper substrate; at least one pin capable of passing through the round holes of the front sheet and the rear sheet and the passive rod; at least one sub-weight. By above mentioned components, the selector serves to lock a predetermined number of main weights and the pin inserts into the sub-weight so as to increase the total weight. A force applied unit serves to drive the passive rod so as to drive the main weight and the sub-weight to operate along the main guide rods and sub-guide rods to achieve the object of training the muscle.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
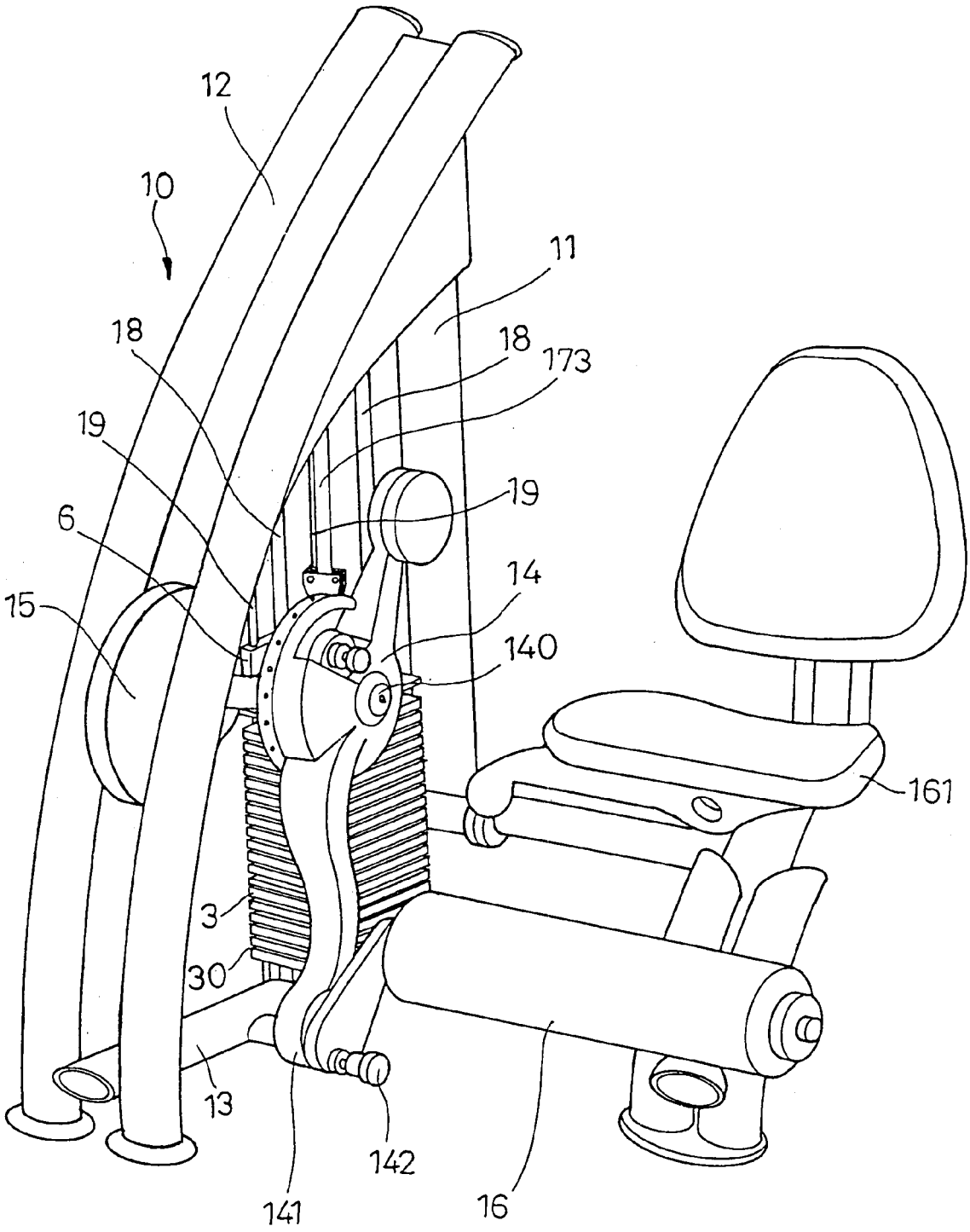
FIG. 1 is a perspective view of the present invention.
Figure 2:
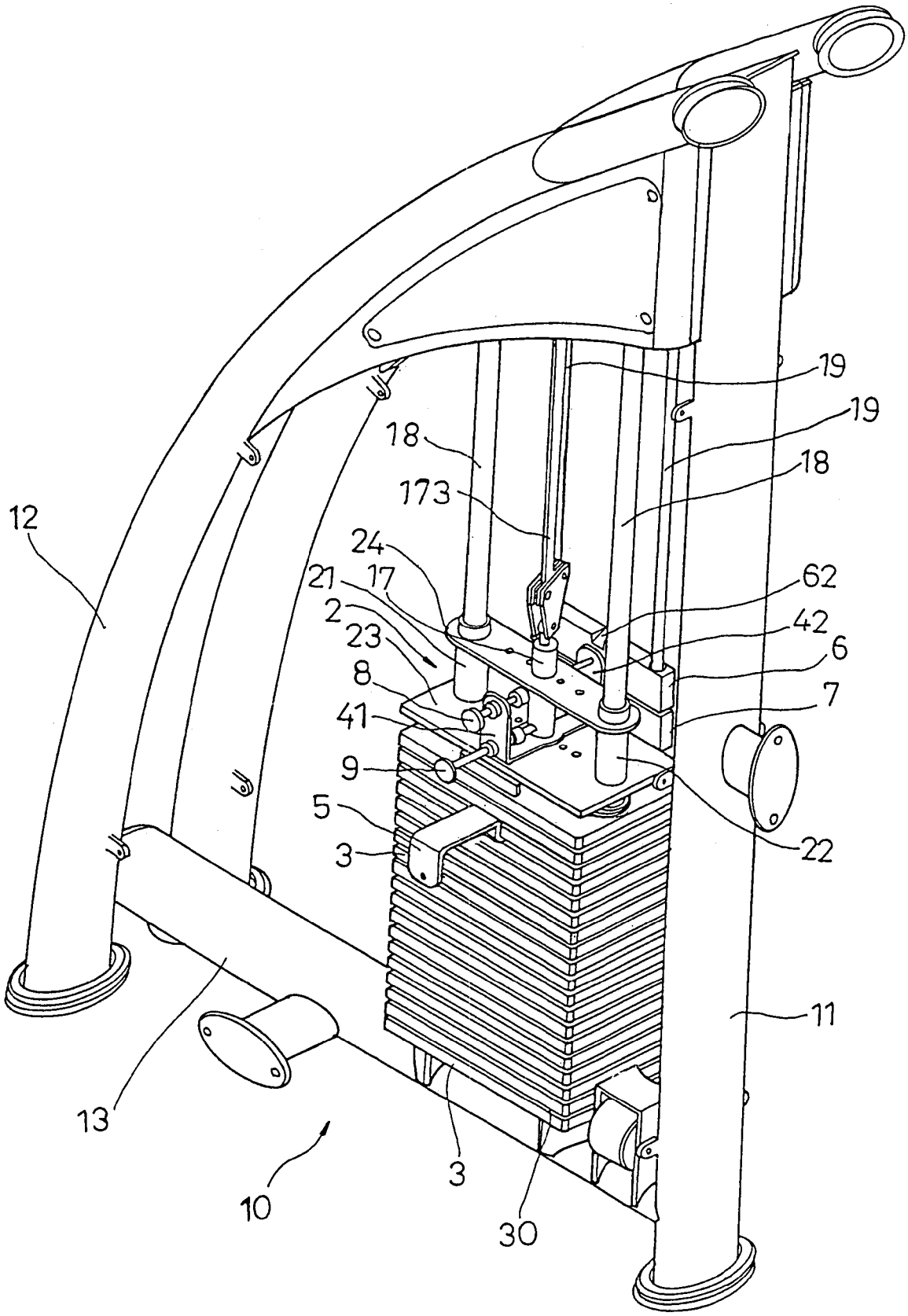
FIG. 2 is a perspective view about the frame and the weights of the present invention.

Referring to FIGS. 1 and 2, the counterweight exercise machine of the present invention is illustrated. The counterweight exercise machine has a frame 10 which can steadily stand on the floor. The frame 10 is formed by a straight rod 11, two cambered rods 12, and a transversal rod 13. The frame 10 is sufficient to support a weight unit applied thereon. The weight unit is formed by a plurality of predetermined main weights 3. The main weights 3 are installed to two main guide rods 18 and a passive rod 17. The main weights 3 are placed into a gap 30 below the passive rod 17. The number of the main weights 3 is determined by a selector 5. The selector 5 is engaged to an annular groove 170 of the passive rod 17. Thereby, a plurality of main weights 3 are locked to the passive rod 17. A shaft 140 extends from the cambered rods 12 so as to fix a rotating wheel 14 and an eccentric wheel 15. Thereby the rotating wheel 14 and the eccentric wheel 15 rotate synchronously. The eccentric wheel 15 is connected to the passive rod 17 by using a belt 173. A linkage rod 14 extending from the rotating wheel 14 is connected to a force applying unit 16 through a post 142. When the force applied unit 16 is driven by a force from a user, the heel of the user applies a force so as to lift the force applied unit 16 and thus the rotating wheel 14 and the eccentric wheel 15 rotates synchronously along clockwise direction. Since the heel of the user serves to balance the weight of the main weights 3 so that the muscle of user is trained. Likewise, the force applying unit 16 can be used to train the hand of the user. By the same effect, in the present invention, when the leg and heel are used as above described, a seat 161 can be installed aside the counterweight exercise machines of present invention and the user can sit on the seat 161 so that the leg can lift the force applied unit 16.

Figure 3:
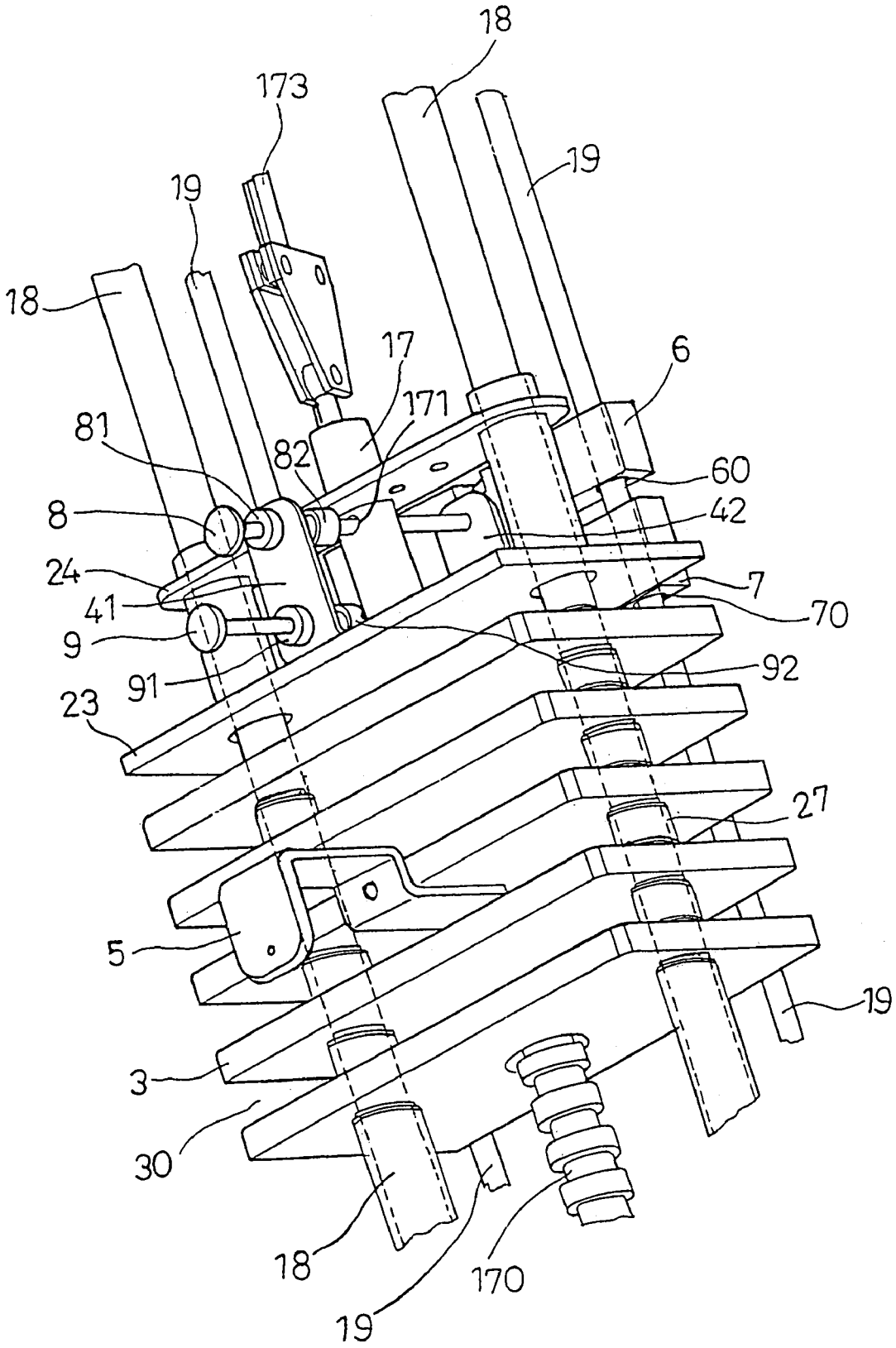
FIG. 3 is a schematic perspective view bout the main weights and the sub-weights of the present invention.
Figure 4:
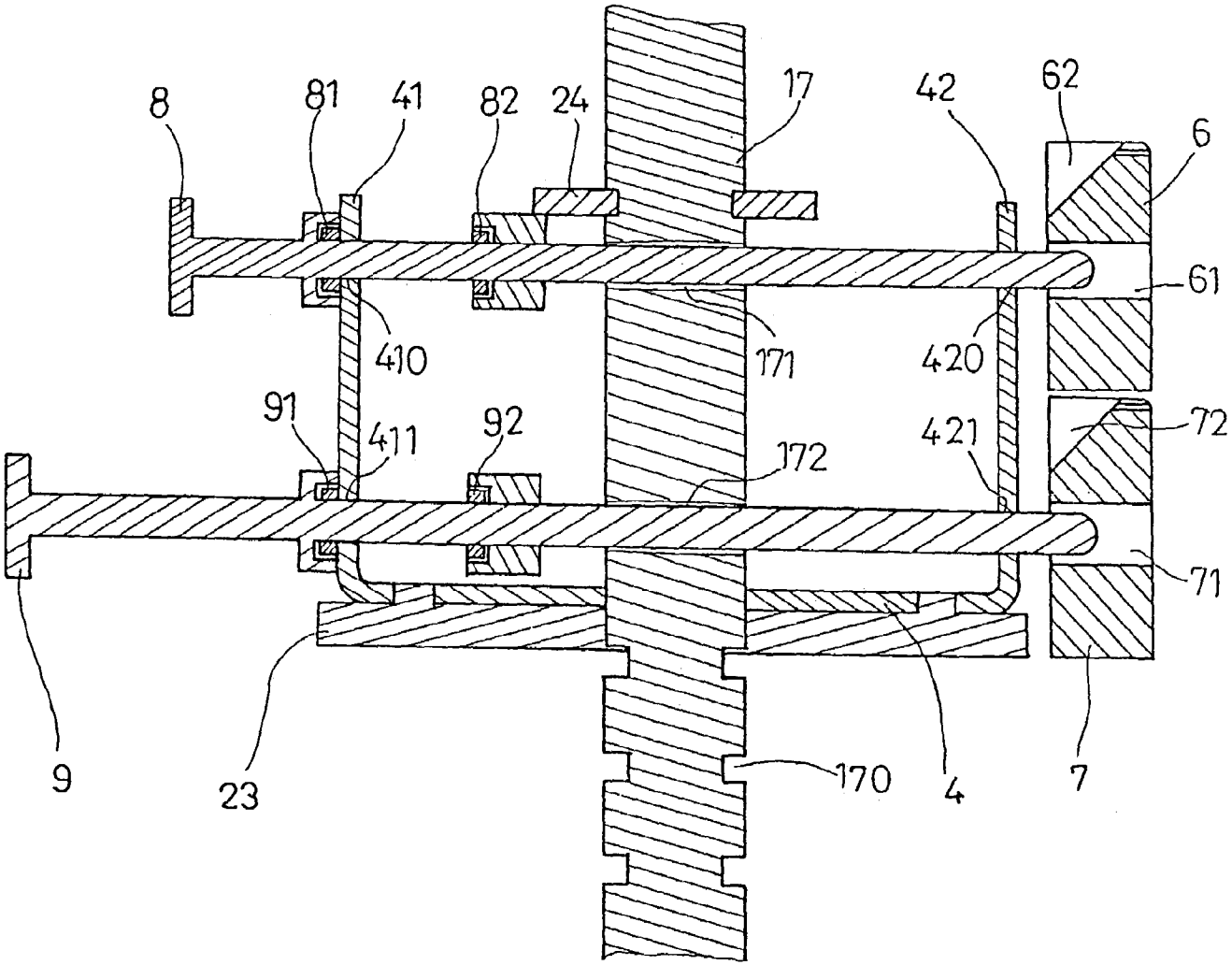
FIG. 4 is a cross sectional view about the combination of the upper pin, the lower pin and the sub-weights.

Each main weight 3 has the same predetermined weight. Thereby the total weight is the integral times of the weight of each main weight 3. To have other selections to the assembly of the main weights 3, sub-weights are designed. The weight of each sub-weight is a part of the main weight 3. Referring to FIGS. 2 and 3, a base 2 has a lower substrate 23 and an upper substrate 24 and two sleeves 21, 22 between the lower substrate 23 and the upper substrate 24. The sleeves 21, 22 enclose the two main guide rods 18. A center section of the base 2 is fixed to an upper section of the passive rod 17. A front sheet 41 and a rear sheet 42 are fixed to the lower substrate 23. The front sheet 41 has an upper round hole 410 and a lower round hole 411. The rear sheet 42 has an upper round hole 420 and lower round hole 421. Referring to FIG. 4, an upper pin 8 and a lower pin 9 pass through the front sheet 41, the rear sheet 42, the upper round holes 410, 411, the lower round holes 420, 421, an upper round hole 171 and a lower round hole 172 of the passive rod 17. Each the upper pin 8 and the lower pin 9 have a force applying portion. Namely, the distal end of the upper pin has magnetic seats 81, 82 and the distal end of the lower pin has magnetic seats 91, 92 corresponding to magnetic seats 81, 82. The magnetic seats 81, 82, 91, 92 stand aside the front sheet 41. If the upper pin 8 and the lower pin 9 are inserted into the round holes 420, 421 of the rear sheet 42, the magnetic seat 81, 91 will absorb the iron front sheet 41. On the contrary, when the upper pin 8 and lower pin 9 are released from the round holes 420, 421 of the rear sheet 42, the magnetic seats 81, 91 are absorbed to the inner lateral surface of the front seat 41. By the magnetic seats 81, 82, 91, 92, the upper pin 8 and lower pin 9 are stable and thus they are difficult to release out.

In the present invention, there are at least one sub-weight 6. In this embodiment, two sub-weights 6, 7 are used in description. The two sub-weights 6, 7 may be same weights or different weights, but they are smaller than that of the main weight 3. One side of the sub-weight 6 has a vertically penetrating round hole 60 and one side of the sub-weight 7 has a vertically penetrating round hole 70, as shown in FIG. 3. The round holes 60, 70 are engaged to two vertical sub-guide rods 19 of the frame 10, and the middle sections of the sub-weights 6, 7 have via holes 61, 71 which are aligned to the round holes 410, 420, 411 and 421 in a same horizontal line. Upper ends of the via holes 61, 71 of the sub-weights 6, 7 have notches 62, 72.

Figure 5:
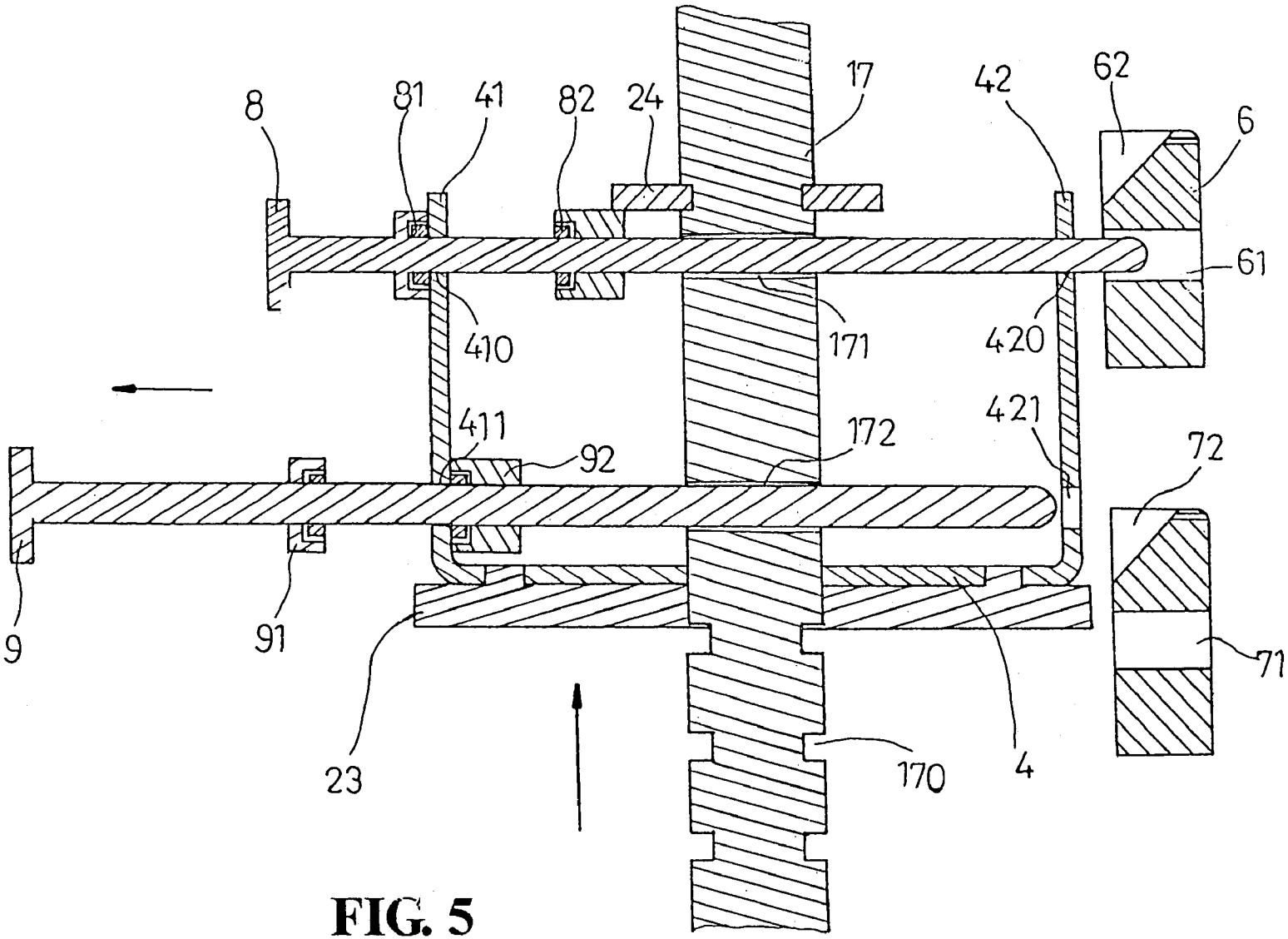
FIG. 5 shows the operation according to FIG. 4.
Figure 6:
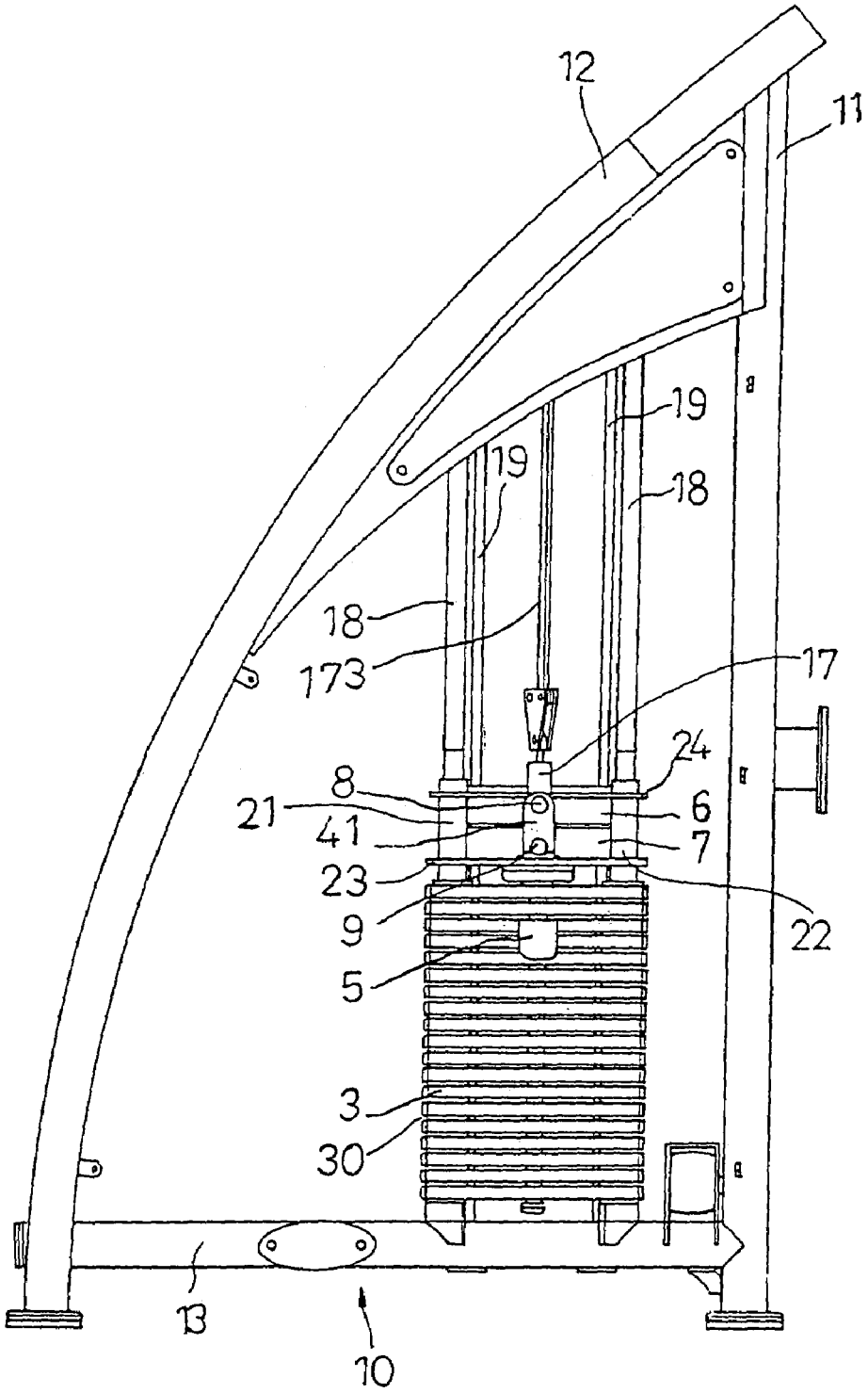
FIG. 6 is a structural view of the FIG. 2.
Figure 7:
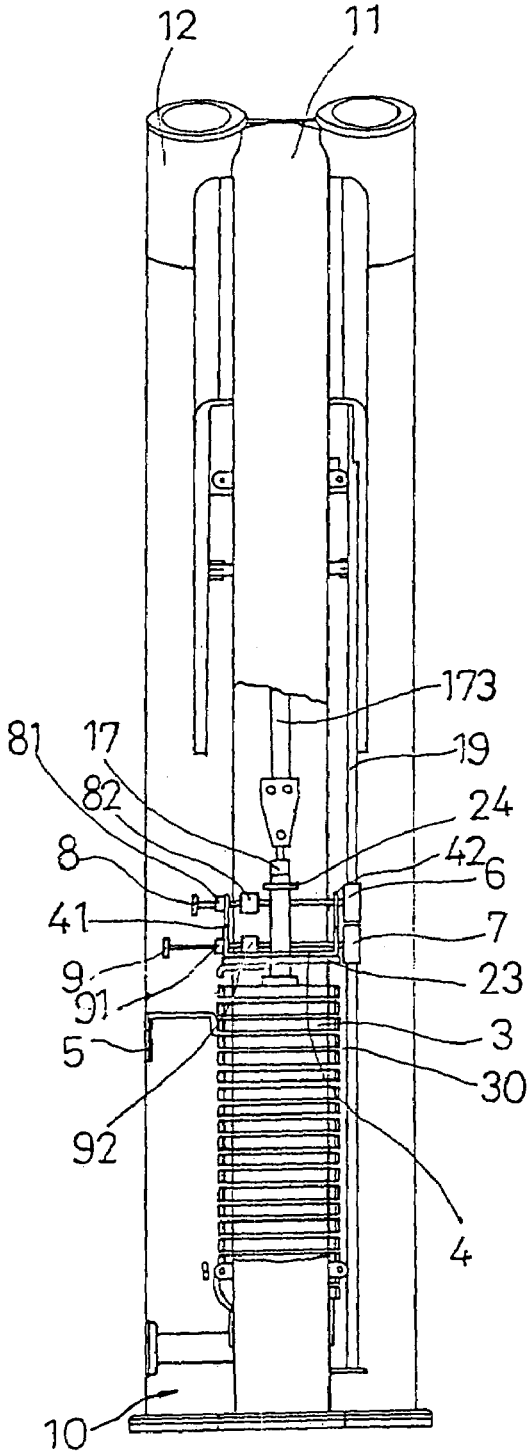
FIG. 7 is another structural view of FIG. 2.

As above mentioned, the selector 5 can fix a plurality of weights 3 less than desired one. Then some sub-weights are added. The upper pin 8 can pass through the via hole 61 of the sub-weight 6. The sub-weight 7 does not be locked by the lower pin 9. When the passive rod 17 is lifted upwards, other than the main weights 3 are lifted along the main guide rods 18, the sub-weight 6 will be lifted along the sub-guide rod 19 (referring to FIG. 5). Thus, as shown in FIG. 4, a larger weight can be added for training. When the main weights 3 and the sub-weights 6, 7 are locked, as shown in FIGS. 6 and 7, the user only needs to apply a force to lift the passive rod 17 for balancing the main weights and the sub-weights, the user can achieve the object of training.

In the present invention, the magnetic seats 81, 82, 91, 92 serve to fix the upper pin 8 and the lower pin 6 to the front sheet 41. If the upper pin 8 and the lower pin 9 are not used to lock the sub-weights 6, 7 and the magnetic seats 81, 91 are absorbed to the front sheet 41, when the passive rod 17 descends in an elevation of the sub-weight 6, the foremost ends of the upper pin 8 and the lower pin 9 will be pushed away due to the notches 62 of the sub-weight 6. Not only the pins 8, 9 will not cut, but also the magnetic seats 82, 92 are absorbed to the front sheet 41 so as to be retained in a safety state.

In summary, in the present invention, the frame 10 is installed with main guide rods 18 and sub-guide rods 19. The main guide rods 18 have a plurality of main weights 3. The sub-guide rods 19 have at least one sub-weight 6. The selector 5 serves to lock the main weights 3. The upper pin 8 and the lower pin 9 serve to lock the sub-weights 6, 7. Thereby the user can select a desire weight for training.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A counterweight exercise machine having a frame capable of standing on a floor steadily; the frame comprising:

two main guide rods;

two sub-guide rods;

a passive rod parallel to the two main guide rods;

at least one main weight having a predetermined weight; the main weight being installed to the two main guide rods;

a selector capable of being inserted into two adjacent main weights and to be engaged to the passive rod;

a base having a lower substrate and an upper substrate; and two sleeves connected to the lower substrate and the upper substrate; the two sleeves enclosing the two main guide rods; the base being engaged to the passive rod to be as an integral body; the lower substrate having a front sheet and a rear sheet; each of the front sheet and rear sheet having at least one round hole;

at least one pin capable of passing through the round holes of the front sheet and the rear sheet and the passive rod;

at least one sub-weight having a weight smaller than that of the main weight; two opposite sides of the sub-weight having vertically penetrating round holes so as to be engaged to the two sub-guide rods vertically; a center of the sub-weight having a via hole for receiving one end of the pin;

wherein by above mentioned components, the selector serves to lock a predetermined number of main weights and the pin inserts into the sub-weight so as to increase the total weight; a force applied unit serves to drive the passive rod so as to drive the main weight and the sub-weight to operate along the main guide rods and sub-guide rods to achieve the object of training.

2. The counterweight exercise machine as claimed in claim 1, wherein each pin has two magnetic seats which are spaced with a predetermined distance; the two magnetic seats are located at two lateral sides of the front sheet; when the sub-weight is locked or unlocked, the front sheet is absorbed so that the pin will not release.

3. The counterweight exercise machine as claimed in claim 1, wherein an upper end of the via hole of the sub-weight has a notch for pushing away the end of the pin to prevent the pin from being cut.

* * * * *